US012104333B1

(12) United States Patent
Dixon

(10) Patent No.: US 12,104,333 B1
(45) Date of Patent: Oct. 1, 2024

(54) SYSTEM AND METHOD FOR PROCESSING RECYCLED ASPHALT PAVEMENT OR AGGREGATE FOR ASPHALT PRODUCTION

(71) Applicant: Reliable Asphalt Products, Inc., Shelbyville, KY (US)

(72) Inventor: Brian Neal Dixon, Mt. Washington, KY (US)

(73) Assignee: Reliable Asphalt Products, Inc., Shelbyville, KY (US)

( * ) Notice: Subject to any disclaimer, the term of this patent is extended or adjusted under 35 U.S.C. 154(b) by 627 days.

(21) Appl. No.: 17/108,790

(22) Filed: Dec. 1, 2020

Related U.S. Application Data

(60) Provisional application No. 63/071,107, filed on Aug. 27, 2020, provisional application No. 62/942,295, filed on Dec. 2, 2019.

(51) Int. Cl.

| | |
|---|---|
| ***E01C 19/00*** | (2006.01) |
| ***C10C 3/00*** | (2006.01) |
| ***E01C 19/05*** | (2006.01) |
| ***E01C 19/10*** | (2006.01) |

(52) U.S. Cl.
CPC ..... *E01C 19/1004* (2013.01); *C10C 3/002* (2013.01); *C10C 3/005* (2013.01); *E01C 19/05* (2013.01); *E01C 19/104* (2013.01); *E01C 19/1063* (2013.01)

(58) Field of Classification Search
None
See application file for complete search history.

(56) References Cited

U.S. PATENT DOCUMENTS

| | | | | |
|---|---|---|---|---|
| 3,128,014 | A * | 4/1964 | Turner | G01G 19/22 222/29 |
| 4,798,533 | A | 1/1989 | Collette | |
| 4,827,854 | A | 5/1989 | Collette | |
| 4,865,259 | A | 9/1989 | Collette | |
| 4,945,839 | A | 8/1990 | Collette | |
| 5,425,923 | A | 6/1995 | Swisher, Jr. et al. | |
| 6,110,430 | A | 8/2000 | Swisher, Jr. et al. | |
| 7,384,181 | B1 | 6/2008 | Collette | |
| 7,479,170 | B1 | 1/2009 | Collette | |
| 7,758,235 | B1 * | 7/2010 | Collette | E01C 19/05 366/147 |

(Continued)

*Primary Examiner* — Prem C Singh
*Assistant Examiner* — Brandi M Doyle
(74) *Attorney, Agent, or Firm* — Stites & Harbison, PLLC; David W. Nagle, Jr.; Gary N. Stewart

(57) ABSTRACT

In a system and method for processing recycled asphalt pavement or aggregate for asphalt production, a heating and drying unit includes a trough positioned within an external housing. A hollow auger is positioned in the trough, such that the recycled asphalt pavement or aggregate received at a first end of the trough is transported to a second end of the trough via rotation of the hollow auger. The trough is constructed of two or more sections to allow for thermal expansion, with only one end of each of the two or more sections connected to the external housing. Heated air is introduced into the trough via an inlet and exits the trough via an outlet. Heated oil is pumped through the hollow auger, entering via an inlet and exiting via an outlet. The heated air and heated oil raise the temperature of the recycled asphalt pavement or aggregate.

14 Claims, 7 Drawing Sheets

(56) References Cited

U.S. PATENT DOCUMENTS

| | | | | |
|---|---|---|---|---|
| 7,807,048 | B2 * | 10/2010 | Collette | C10B 47/44<br>208/400 |
| 7,993,048 | B1 | 8/2011 | Collette et al. | |
| 8,109,009 | B1 | 2/2012 | Collette et al. | |
| 2014/0112090 | A1 * | 4/2014 | Gencer | E01C 19/1004<br>366/25 |
| 2015/0259864 | A1 * | 9/2015 | Roy | E01C 19/45<br>404/110 |
| 2016/0199799 | A1 * | 7/2016 | Huh | B28C 5/2036<br>366/24 |

* cited by examiner

SYSTEM AND METHOD FOR PROCESSING RECYCLED ASPHALT PAVEMENT OR AGGREGATE FOR ASPHALT PRODUCTION

CROSS-REFERENCE TO RELATED APPLICATIONS

The present application claims priority to U.S. Patent Application Ser. No. 62/942,295 filed on Dec. 2, 2019 and U.S. Patent Application Ser. No. 63/071,107 filed on Aug. 27, 2020, the entire disclosures of which are incorporated herein by reference.

BACKGROUND OF THE INVENTION

The present invention is a system and method for processing recycled asphalt pavement or aggregate for asphalt production.

As described in U.S. Pat. No. 7,758,235, which is incorporated herein by reference, bituminous paving materials that have been removed from road surfaces are commonly referred to as recycled asphalt pavement ("RAP"). RAP is commonly removed by milling, grinding or ripping, and the RAP can then be processed and used in the production of new asphalt.

As also described in U.S. Pat. No. 7,758,235, however, there are some problems encountered in using RAP in the manufacture of new asphalt. For instance, when attempting to inject cold wet RAP into a hot-mix asphalt plant, sudden and violent steam expansion can occur when the hot virgin aggregate (600° F.-900° F.) encounters the cold wet RAP, overloading exhaust system airflow capacity. In the case of a drum mixer-type asphalt plant, where the injection of the RAP is done inside of the aggregate dryer, the steam expansion restricts the dryer air flow and overloads the exhaust vacuum system, forcing the operator to lower plant production rates to restore exhaust vacuum and air flow on the drum. In the case of a batch-type asphalt plant, where the RAP is injected into the weigh hopper section of the batcher above the pug mill mixer, a violent steam expansion similarly occurs, blowing steam and dust into the air and sometimes even damaging the hopper section.

Accordingly, in order to successfully use RAP in the production of new asphalt, some processing of the RAP is necessary to dry the RAP and to increase its temperature before insertion into an asphalt production plant with virgin aggregate materials.

In U.S. Pat. No. 7,758,235, a gas combustion system or other heat exchanger is used in combination with a heating and drying unit to dry the RAP and to increase its temperature before insertion into an asphalt production plant. The heating and drying unit contains a hollow auger turning within a trough. RAP is fed through a chute and down into the trough of the heating and drying unit, where it is transported from one end of the trough to the other end by the auger. The gas combustion system is used to generate heated air and heated oil (or a similar heat transfer liquid). In the heating and drying unit, as the RAP moves from one end of the trough to the other end, the RAP is subjected to heat transfer from hot air pumped from the gas combustion system and into the heating and drying unit. Furthermore, in the heating and drying unit, hot oil from the gas combustion system is pumped through the hollow auger, so that the RAP is also subjected to heat transfer via the hot oil. The hot oil also preferably flows in a direction opposite to the flow of the RAP.

However, such a construction suffers from deficiencies of its own, including thermal expansion and stress issues. For example, thermal expansion often caused the trough to expand more rapidly than an external housing to which it was secured, leading to a failure of the welds between the trough and the external housing, thus causing the trough to leak. Furthermore, such a construction may not provide sufficient heating and/or moisture removal.

Additionally, in a cold-mix asphalt plant, unheated aggregate is commonly mixed with an asphalt emulsion to create a cold mixture that is useful for patching and repairing asphalt pavement. However, in certain circumstances, it would be desirable and advantageous to preheat the aggregate before it is introduced into the cold-mix asphalt plan. Preheating the aggregate helps to remove any surface moisture. It also elevates the temperature of the aggregate allowing for better adhesion of the asphalt emulsion. This reduces the mixing time required, thus increasing the cold mix production rate.

SUMMARY OF THE INVENTION

The present invention is a system and method for processing recycled asphalt pavement or aggregate for asphalt production, which addresses certain deficiencies of prior art constructions.

An exemplary system for processing recycled asphalt pavement ("RAP") made in accordance with the present invention generally comprises: a heat exchanger (such as an oil heater); and a heating and drying unit, including a trough positioned within an external housing and configured to receive the recycled asphalt pavement, with a hollow auger positioned in and rotating within the trough (which acts as a screw conveyor). RAP is fed through a chute and down into the trough of the heating and drying unit, where it is transported from a first end of the trough to a second end of the trough via rotation of the auger. The heat exchanger is used to generate heated air and heated oil (or a similar heat transfer liquid). The heat exchanger could be one integrated unit for generating both heated air and heated oil, or it could be two separate units—one for generating heated air and one for generating heated oil. In the heating and drying unit, as the RAP moves from the first end of the trough to the second end of the trough, the RAP is subjected to heat transfer from heated air delivered from the heat exchanger and introduced into the heating and drying unit, entering the trough via an inlet and exiting the trough via an outlet. Furthermore, in the heating and drying unit, heated oil is delivered from the heat exchanger and is pumped through the hollow auger, entering via an inlet and exiting via an outlet, preferably flowing in a direction opposite to the flow of the RAP.

In the exemplary system of the present invention, the trough is not welded or rigidly fixed to the external housing. Moreover, the trough is constructed of two or more sections, which are aligned and collectively define a cavity for receiving the auger. Each section is only pinned or otherwise connected at one end to the external housing, thus allowing for thermal expansion (or lengthening). Where the respective sections come together, a lap plate may be positioned to bridge the gap between adjacent sections.

In some embodiments, guide members are positioned at left and right lateral top edges of the trough. Each of the guide members is secured to the external housing by one or more fasteners. However, each of the guide members is not secured or otherwise fixed to the trough; rather, each of the guide members extends down over either the left lateral top edge or the right lateral top edge of the trough. Thus, the guide members prevent any lateral (side-to-side) movement of the trough with respect to the external housing, but still allow for thermal expansion (or lengthening) of the trough in a longitudinal direction. Furthermore, the guide members prevent materials from getting between the trough and the external housing.

In some embodiments, lateral support bars are positioned at spaced intervals along the length of the trough to assist in maintaining its rigidity and preventing any collapse of the trough.

In some embodiments, the trough (and the auger) is sloped downward (e.g., approximately) 3° from the first end to the second end, such that the force of gravity assists the auger in transporting RAP from one end of the trough to the other end, thus reducing power consumption.

In some embodiments, breaker bars (which also may be referred to as "scraper bars") are installed on the periphery of the auger, which scrape any built-up material from the walls of the trough as the auger rotates. This reduces the friction between the outer edge of the auger and any built-up material on the walls of the trough. As a result of the use of such breaker bars, there is a reduced current draw on the motor that drives the auger, reducing power consumption.

In some embodiments, the auger and/or the inner surfaces of the trough are provided with a hard facing.

In some embodiments, the exemplary system further includes a coater configured to receive the RAP from the heating and drying unit. The purpose of the coater is to mix the RAP and liberate moisture (steam) from the RAP. Also, additional materials can be introduced into the RAP that is in the coater, such as asphalt cement (AC) or an asphalt rejuvenator, in order to produce different products, before the RAP is delivered to an asphalt production plant, i.e., a hot-mix asphalt plant.

In some embodiments, the exemplary system further includes a flow control unit that is interposed between the heating and drying unit and the coater and is configured to control flow of the RAP from the heating and drying unit into the coater. In this regard, the coater needs a consistent flow of RAP to ensure uniform mixing with the additional materials injected into the coater, such as asphalt cement (AC) or an asphalt rejuvenator.

An exemplary method for processing recycled asphalt pavement for use in asphalt production thus comprises the steps of: (i) introducing recycled asphalt pavement into a heating and drying unit, including a trough positioned within an external housing, wherein the trough is constructed of two or more sections to allow for thermal expansion, with only one end of each of the two or more sections connected to the external housing, and wherein a hollow auger is positioned in the trough; (it) rotating the hollow auger within the trough to transport the recycled asphalt pavement received at a first end of the trough to a second end of the trough; (iii) introducing heated air into the heating and drying unit, entering the trough via an inlet and exiting the trough via an outlet; (iv) introducing heated oil through the hollow auger, entering via an inlet and exiting via an outlet, and (v) discharging the recycled asphalt pavement at an elevated temperature from the second end of the trough. In some implementations, an exemplary method for processing recycled asphalt pavement for use in asphalt production further comprises the steps of: (vi) introducing the recycled asphalt pavement from the heating and drying unit into a coater; and (vii) agitating and mixing the recycled asphalt pavement in the coater, liberating moisture from the recycled asphalt pavement.

Additionally, as mentioned above, in certain circumstances, it would be desirable and advantageous to preheat the aggregate before it is introduced into the cold-mix asphalt plant. In that case, the aggregate is introduced into the trough of the heating and drying unit, where it is transported from the first end of the trough to the second end of the trough via rotation of the auger. The heat exchanger is used to generate heated air and heated oil (or a similar heat transfer liquid). In the heating and drying unit, as the aggregate moves from the first end of the trough to the second end of the trough, the aggregate is subjected to heat transfer from heated air delivered from the heat exchanger and introduced into the heating and drying unit, entering the trough via the inlet and exiting the trough via the outlet. Furthermore, in the heating and drying unit, heated oil is delivered from the heat exchanger and is pumped through the hollow auger, entering via the inlet and exiting via the outlet, preferably flowing in a direction opposite to the flow of the aggregate.

An exemplary method for processing aggregate for use in asphalt production in a cold-mix asphalt plant thus comprises the steps of: (i) introducing aggregate into a heating and drying unit, including a trough positioned within an external housing, wherein the trough is constructed of two or more sections to allow for thermal expansion, with only one end of each of the two or more sections connected to the external housing, and wherein a hollow auger is positioned in the trough; (ii) rotating the hollow auger within the trough to transport the aggregate received at a first end of the trough to a second end of the trough; (iii) introducing heated air into the heating and drying unit, entering the trough via an inlet and exiting the trough via an outlet; (iv) introducing heated oil through the hollow auger, entering via an inlet and exiting via an outlet; and discharging the aggregate at an elevated temperature from the second end of the trough.

DETAILED DESCRIPTION OF THE INVENTION

The present invention is a system and method for processing recycled asphalt pavement or aggregate for asphalt production.

Figure 1:
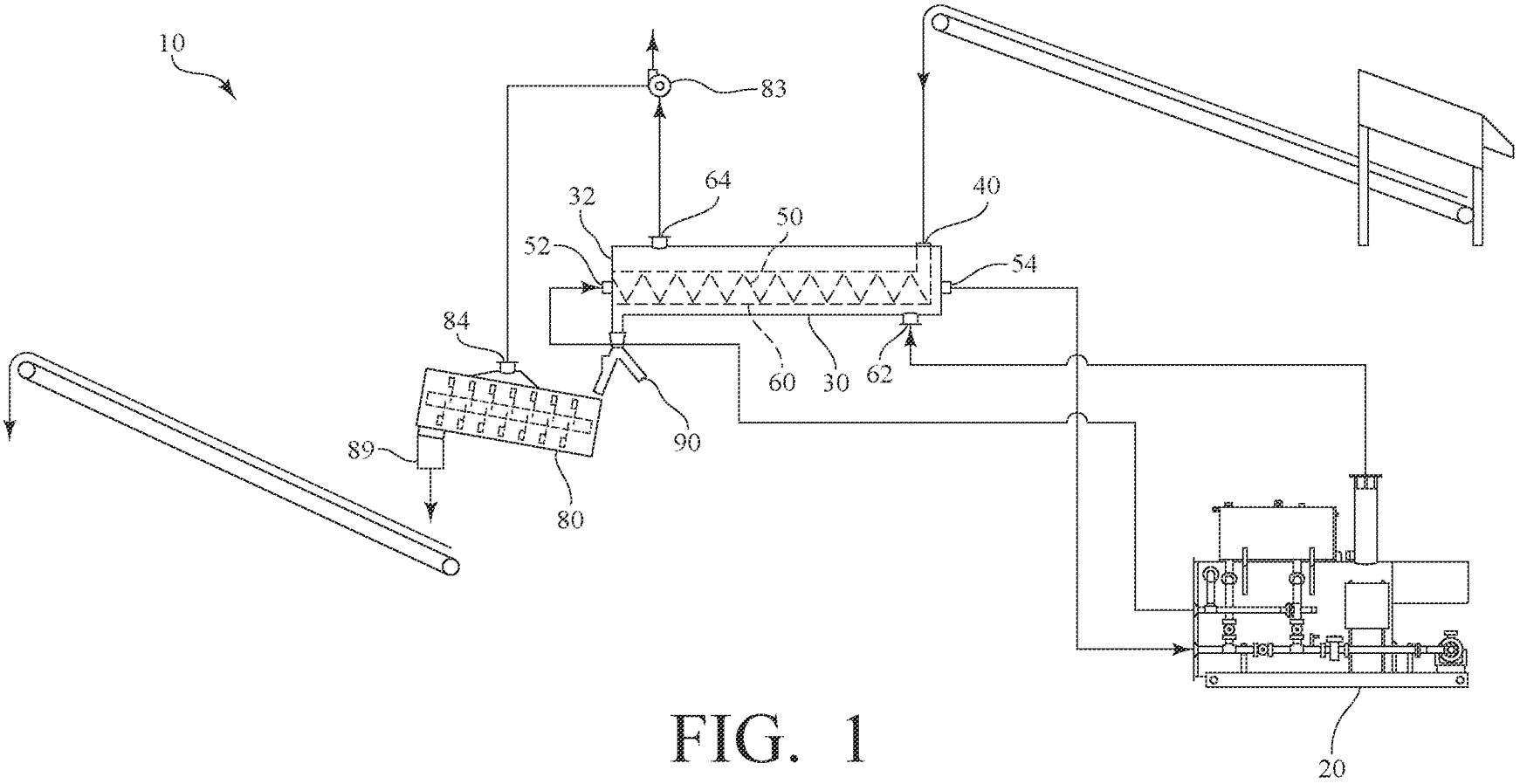
FIG. 1 is a schematic view of an exemplary system for processing recycled asphalt pavement or aggregate made in accordance with the present invention.

FIG. 1 is a schematic view of an exemplary system 10 for processing recycled asphalt pavement ("RAP") made in accordance with the present invention. As shown in FIG. 1, the exemplary system generally comprises: a heat exchanger 20 (such as an oil heater); and a heating and drying unit 30, including a trough 60 positioned within an external housing 32 and configured to receive the recycled asphalt pavement, with a hollow auger 50 positioned in and rotating within the trough 60 (which acts as a screw conveyor). As with prior art constructions, RAP is fed through a chute 40 and down into the trough 60 of the heating and drying unit 30, where it is transported from a first end of the trough 60 to a second end of the trough 60 via rotation of the auger 50. The heat exchanger 20 is used to generate heated air and heated oil (or a similar heat transfer liquid). In this regard, the heat exchanger 20 could be one integrated unit for generating both heated air and heated oil, or it could be two separate units-one for generating heated air and one for generating heated oil. In the heating and drying unit 30, as the RAP moves from the first end of the trough 60 to the second end of the trough 60, the RAP is subjected to heat transfer from heated air delivered from the heat exchanger 20 and introduced into the heating and drying unit 30, entering the trough 60 via an inlet 62 and exiting the trough 60 via an outlet 64. Furthermore, in the heating and drying unit 30, heated oil is delivered from the heat exchanger 20 and is pumped through the hollow auger 50, entering via an inlet 52 and exiting via an outlet 54, preferably flowing in a direction opposite to the flow of the RAP.

In prior art constructions, the trough was commonly welded to an external housing. However, in operation, thermal expansion often caused the trough to expand more rapidly than the external housing, leading to a failure of the welds between the trough and the external housing, thus causing the trough to leak.

Figure 2:
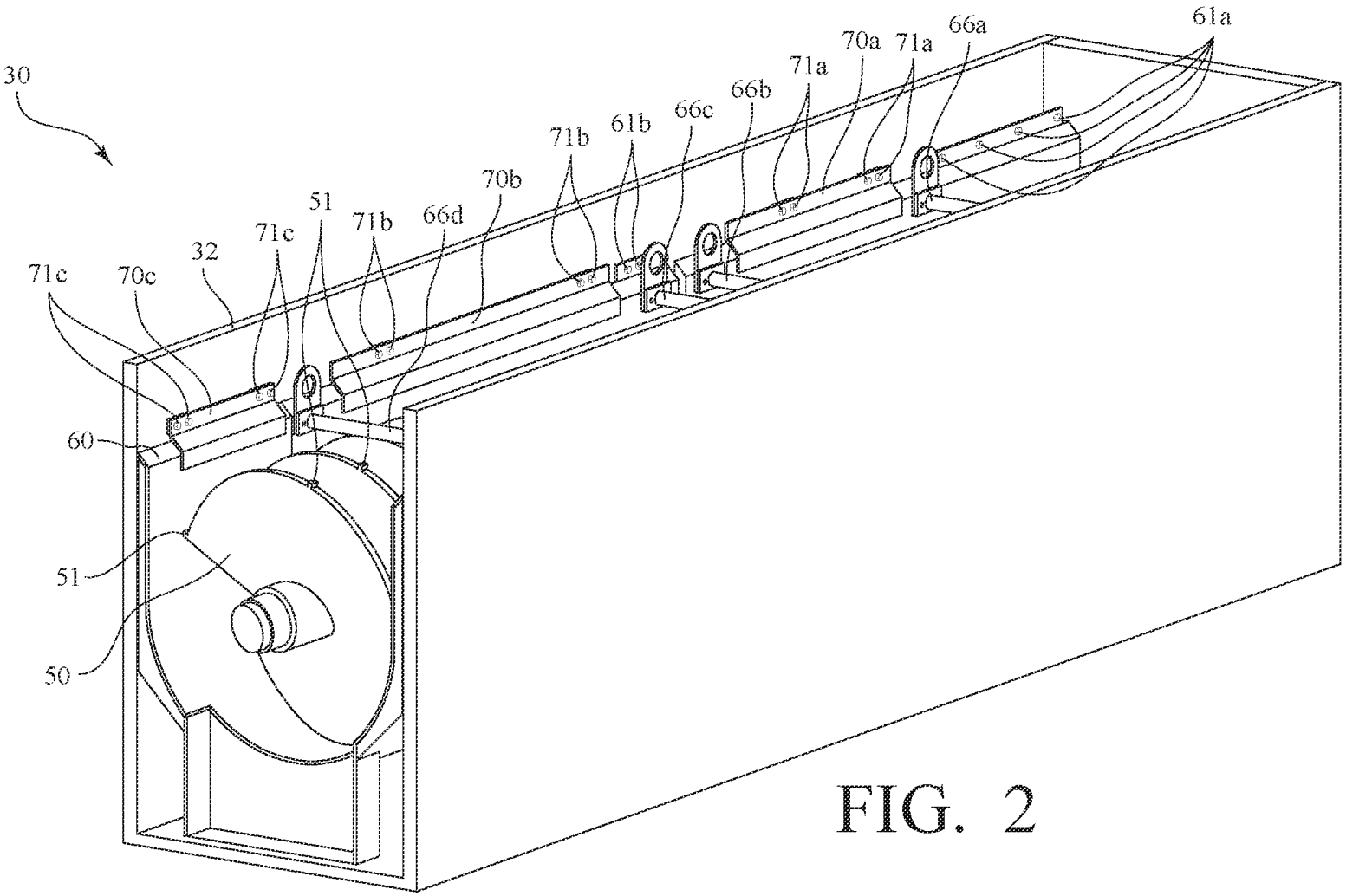
FIG. 2 is a perspective view of the heating and drying unit of the exemplary system of FIG. 1.

FIG. 2 is a perspective view of the heating and drying unit 30 of the exemplary system 10 of FIG. 1, with the trough 60 positioned within the external housing 32.

Figure 3:
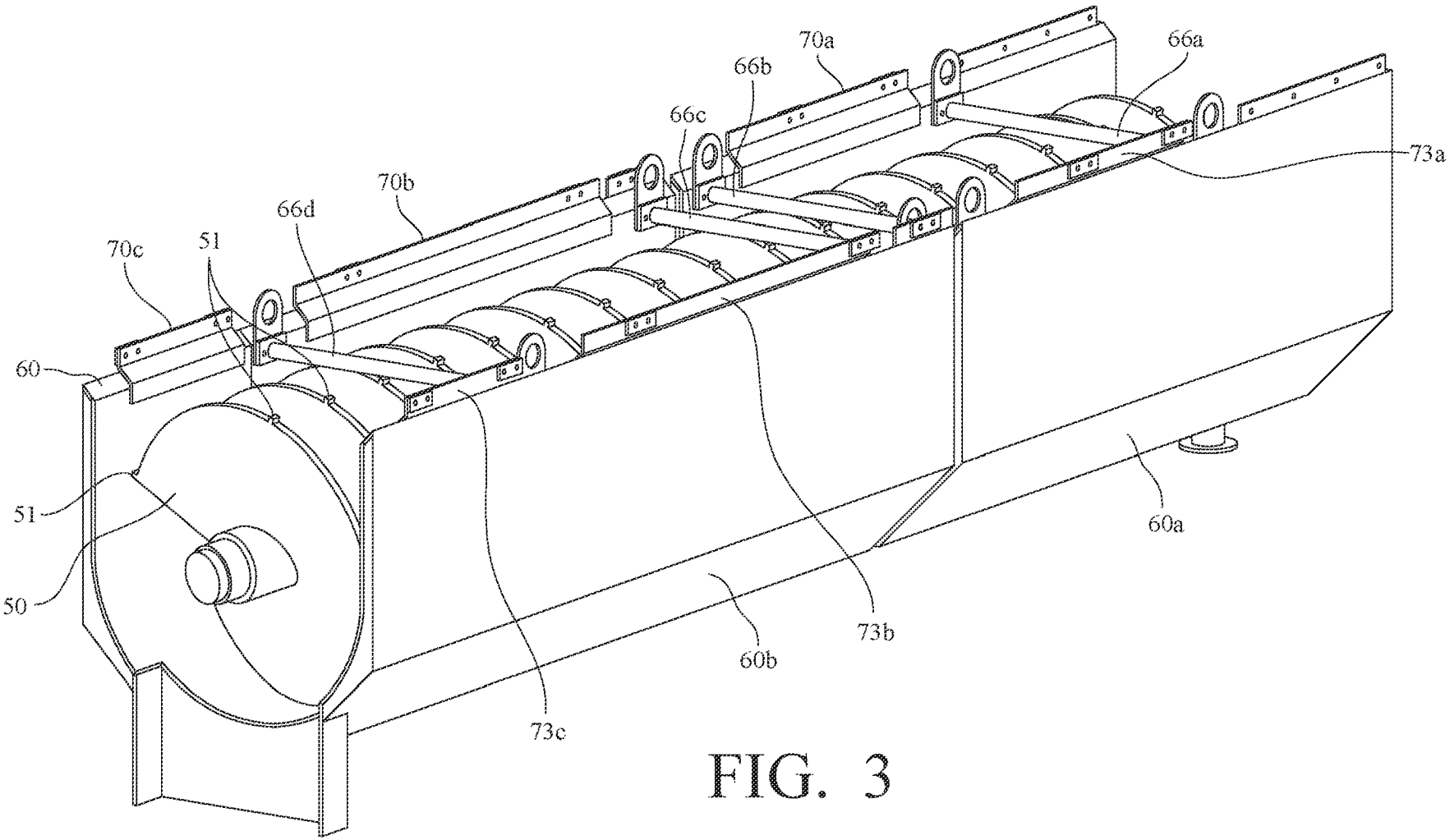
FIG. 3 is a perspective view of the trough and the auger of the heating and drying unit of FIG. 2.

FIG. 3 is a perspective view of the auger 50 and the trough 60 of the heating and drying unit 30 of FIG. 2, without the external housing 32 to illustrate some of the other components and features of the heating and drying unit 30.

Referring now to FIGS. 2 and 3, in the exemplary system 10 of the present invention, the trough 60 is not welded or rigidly fixed to the external housing 32, as further discussed below. Moreover, the trough 60 is constructed of two or more sections, which are aligned and collectively define a cavity for receiving the auger 50 (FIG. 2), but allow for thermal expansion. In this exemplary embodiment, the trough 60 includes a first (or inlet) section 60*a* and second (or outlet) section 60*b*. Each of the first section 60*a* and the second section 60*b* is only pinned or otherwise connected at one end to the external housing, thus allowing for thermal expansion (or lengthening). Specifically, bolts or similar fasteners 61*a* are used to secure a proximal end of the first section 60*a* to the external housing 32, and bolts or similar fasteners 61*b* are similarly used to secure a proximal end of the second section 60*b* to the external housing 32. There are no such connections at the respective distal ends of the first section 60*a* and the second section 60*b*. Where the first section 60*a* and the second section 60*b* come together, a lap plate (not shown) is positioned to bridge the gap between the first section 60*a* and the second section 60*b*. In this regard, in this exemplary embodiment, the lap plate is secured to an internal floor surface of the first section 60*a*, and then extends over the gap between the first section 60*a* and the second section 60*b*.

Referring still to FIGS. 2 and 3, in the exemplary embodiment, guide members 70*a-c*, 73*a-c* are positioned at left and right lateral top edges of the trough 60. Each of the guide members 70*a-c*, 73*a-c* is secured to the external housing 32 by one or more fasteners. (In FIG. 2, such fasteners are visible on one side of the trough 60 and identified with reference numbers 71*a*, 71*b*, 71*c*.) However, each of the guide members 70*a-c*, 73*a-c* is not secured or otherwise fixed to the trough 60; rather, each of the guide members 70*a-c*, 73*a-c* extends down over either the left lateral top edge or the right lateral top edge of the trough 60. Thus, the guide members 70*a-c*, 73*a-c* prevent any lateral (side-to-side) movement of the trough 60 with respect to the external housing 32, but still allow for thermal expansion (or lengthening) of the trough 60 in a longitudinal direction. Furthermore, the guide members 70*a-c*, 73*a-c* prevent materials from getting between the trough 60 and the external housing 32.

Referring still to FIGS. 2 and 3, in this exemplary embodiment, lateral support bars 66*a*-66*d* are positioned at spaced intervals along the length of the trough 60 to assist in maintaining its rigidity and preventing any collapse of the trough 60.

As a further refinement, although not clearly shown in FIGS. 2 and 3, in the exemplary embodiment, the trough 60 (and the auger 50) is preferably sloped downward (e.g., approximately) 3° from the first end to the second end, such that the force of gravity assists the auger 50 in transporting RAP from one end of the trough 60 to the other end, thus reducing power consumption.

As a further refinement, in this exemplary embodiment, breaker bars 51 (which also may be referred to as "scraper bars") are installed on the periphery of the auger 50, which scrape any built-up material from the walls of the trough 60 as the auger 50 rotates. This reduces the friction between the outer edge of the auger 50 and any built-up material on the walls of the trough 60. As a result of the use of such breaker bars 51, there is a reduced current draw on the motor that drives the auger 50, reducing power consumption. Although not shown, the breaker bars 51 may be bolted or similarly fastened to the auger 50, rather than being welded to the auger 50, to facilitate removal and replacement of any damage breaker bars 51.

As a further refinement, to improve operation and extend the life of the auger 50, in some embodiments, the auger 50 is provided with a hard facing. For example, in one exemplary embodiment, the auger 50 is plated with ⅜-inch chrome carbide.

As a further refinement, to improve operation and extend the life of the trough 60, in some embodiments, the inner surfaces of the trough 60 are provided with a hard facing.

Referring again to FIG. 1, in some embodiments, the exemplary system 10 further includes a coater 80 configured to receive the RAP from the heating and drying unit 30. The purpose of the coater 80 is to mix the RAP and liberate moisture (steam) from the RAP. Also, additional materials can be introduced into the RAP that is in the coater 80, such as asphalt cement (AC) or an asphalt rejuvenator, in order to produce different products, before the RAP is delivered to an asphalt production plant, i.e., a hot-mix asphalt plant.

Figure 4:
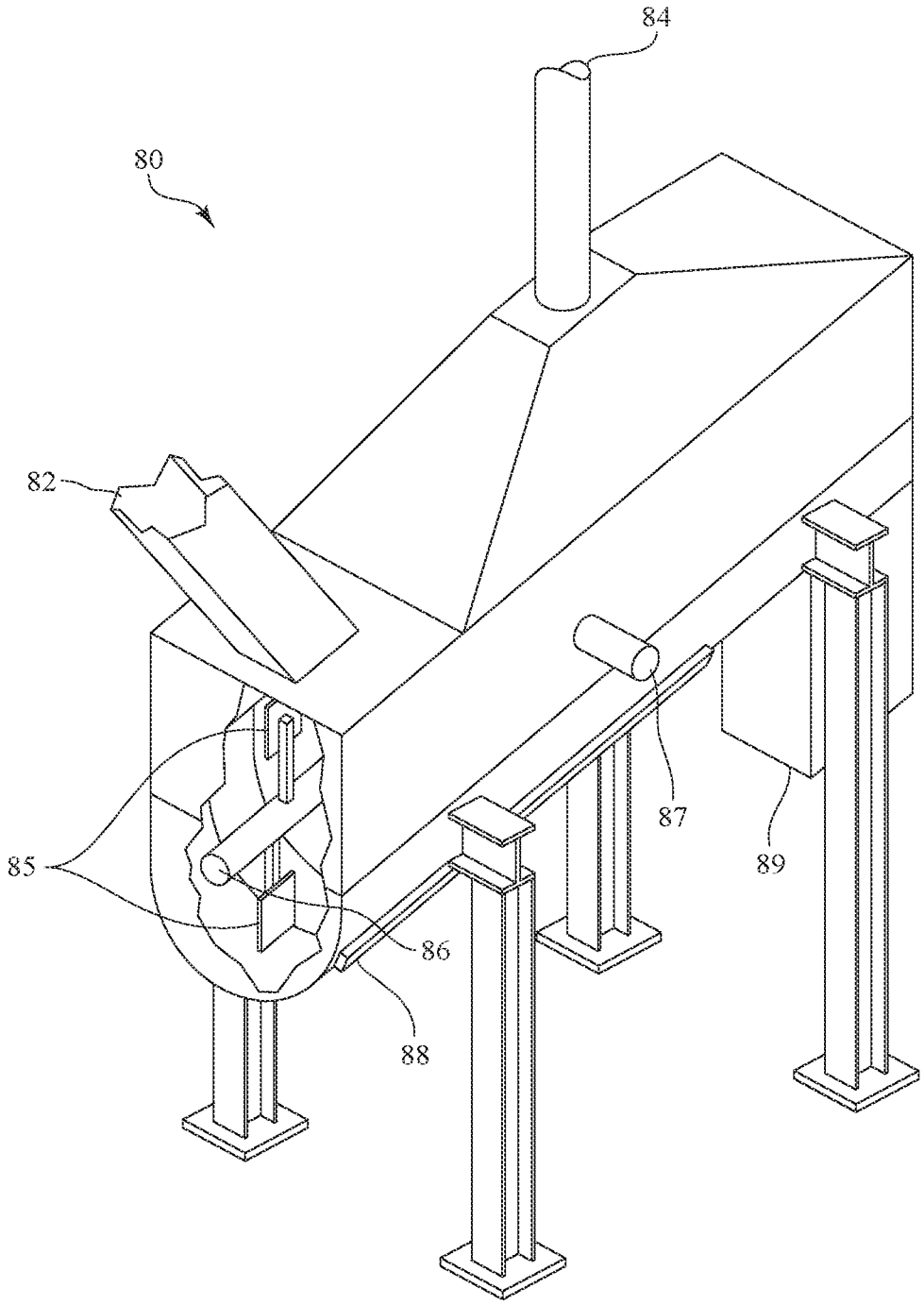
FIG. 4 is a perspective view of an exemplary coater for use in a system for processing recycled asphalt pavement made in accordance with the present invention.

FIG. 4 is a perspective view of an exemplary coater 80 for use in a system for processing recycled asphalt pavement made in accordance with the present invention. As shown, in this exemplary embodiment, the RAP from the heating and drying unit 30 is introduced into the coater 80 via an inlet 82. Within the coater 80, mixing paddles 85 are mounted to a rotating shaft 86 to agitate and mix the RAP. As a result of such agitation and mixing, moisture (steam) is liberated from the RAP and exits via an outlet duct 84. In some embodiments, a vacuum is applied to the outlet duct 84, actively drawing out the moisture (steam) that has been liberated from the RAP. For example, and as shown in FIG. 1, a fan 83 may be connected to the outlet duct 84 and used to draw out the out the moisture (steam) that has been liberated from the RAP. Furthermore, in the exemplary embodiment shown in FIG. 1, the fan 83 is also connected to the outlet 64 to draw air from the trough 60.

Referring again to FIG. 4, in this exemplary embodiment, the coater 80 also includes an injection port 87, via which additional materials can be introduced into the RAP that is in the coater 80, such as asphalt cement (AC) or an asphalt rejuvenator, in order to produce different products.

Referring still to FIG. 4, in this exemplary embodiment, the coater 80 also includes one or more channels 88 for receiving and circulating heated oil (or a similar heat transfer liquid), which can further heat the RAP that is in the coater 80 and aid in moisture removal.

Referring still to FIG. 4, from the coater 80, the RAP (which is now at an elevated temperature) is discharged via an outlet 89 for delivery to an asphalt production plant, i.e., a hot-mix asphalt plant.

Referring again to FIG. 1, in some embodiments, the exemplary system 10 further includes a flow control unit 90 that is interposed between the heating and drying unit 30 and the coater 80 and is configured to control flow of the RAP from the heating and drying unit 30 into the coater 80. In this regard, the coater 80 needs a consistent flow of RAP to ensure uniform mixing with the additional materials injected into the coater 80, such as asphalt cement (AC) or an asphalt rejuvenator.

Figure 5:
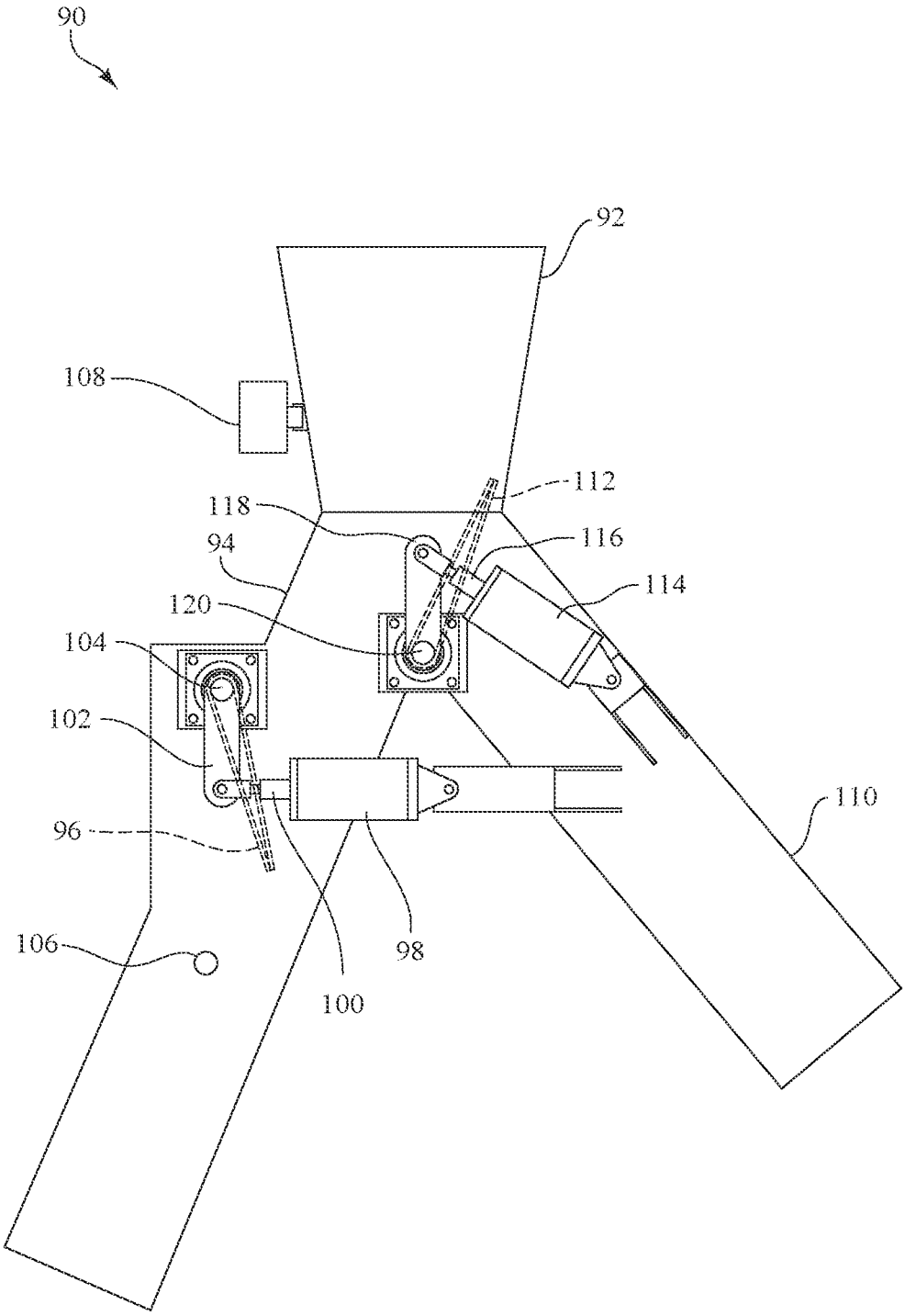
FIG. 5 is a perspective view of an exemplary flow control unit for use in a system for processing recycled asphalt pavement made in accordance with the present invention.

FIG. 5 is a perspective view of an exemplary flow control unit 90 for use in a system for processing recycled asphalt pavement made in accordance with the present invention.

Figure 6:
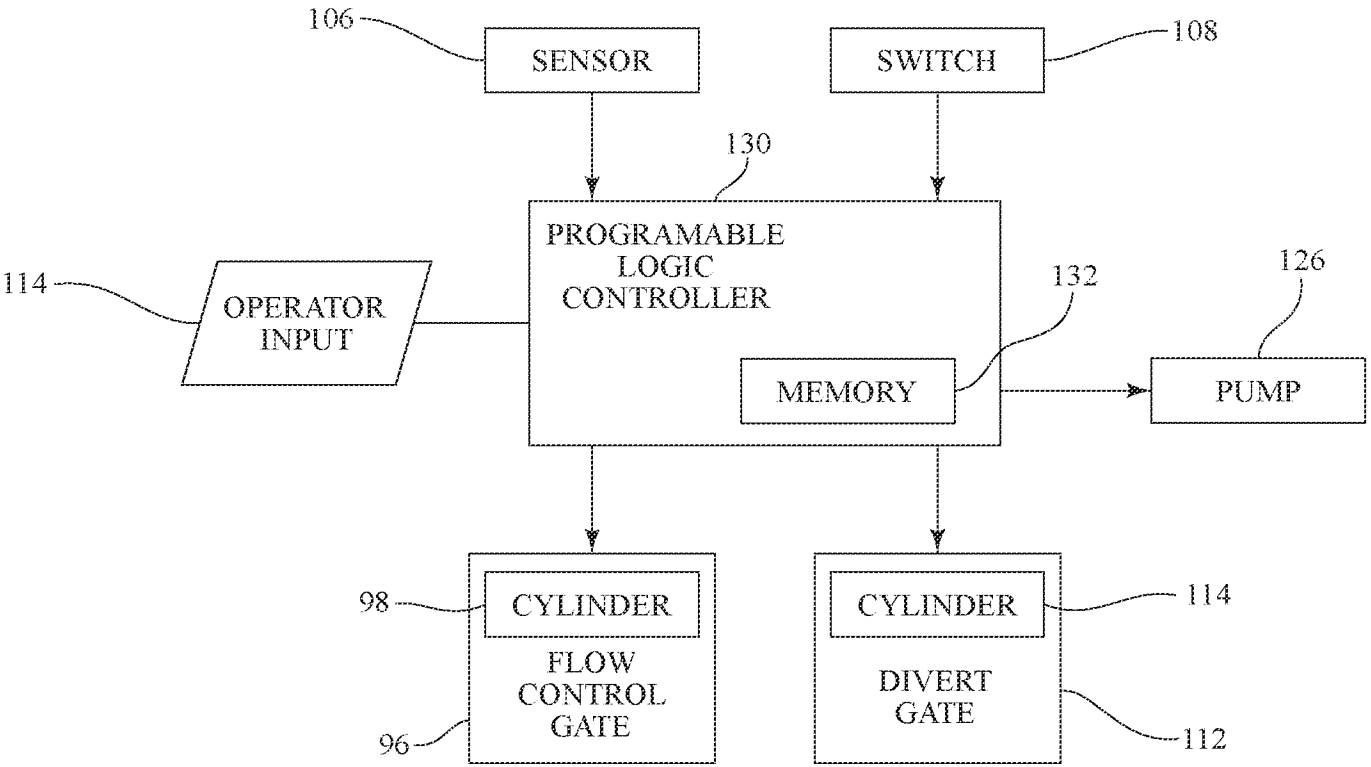
FIG. 6 is a schematic diagram that illustrates the operation of the exemplary flow control unit 90 of FIG. 5.

FIG. 6 is a schematic diagram that illustrates the operation of the exemplary flow control unit 90 of FIG. 5.

Referring now to FIGS. 5 and 6, the RAP is received in a hopper 92. It moves from the hopper 92 under the force of gravity through a conduit 94 to the coater 80. Within the conduit 94 is a flow control gate 96, which is opened and/or closed by a hydraulic or pneumatic cylinder 98 to modulate flow of the RAP through the conduit 94. Specifically, in this exemplary embodiment, the cylinder 98 includes a rod 100 that is selectively extended or retracted. The rod 100 is connected to a linkage 102, which, in turn, is connected to a shaft 104. The flow control gate 96 is mounted to the shaft 104. Thus, extension or retraction of the rod 100 results in rotation of the shaft 104, and thus, rotation of the flow control gate 96 to modulate the flow of the RAP through the conduit 94. For instance, in at least some embodiments, the flow control gate 96 is set at a predetermined initial position (e.g., three inches open). A sensor 106 (such as a paddle switch) is positioned in the conduit 94 to monitor the volume of RAP flowing through the conduit 94, and the sensor 106 transmits a signal representative of the measured flow to a programmable logic controller 130, which includes a memory component 132. If, based on the signal from the sensor 106, the programmable logic controller 130 determines that there is a lack of material flowing through the conduit 94, the programmable logic controller 130 will transmit a control signal to the hydraulic or pneumatic cylinder 98 of the flow control gate 96 to close a predetermined amount. In one preferred implementation, the flow control gate 96 will close in predetermined increments and at predetermined intervals until, based on the signal from the sensor 106, the programmable logic controller 130 determines that normal flow has been restored, at which time the programmable logic controller 130 will transmit a control signal to return the flow control gate 96 to the predetermined initial position. Alternatively, an operator user may manually adjust the position of the flow control gate 96 via an operator input 124 to the programmable logic controller 130.

As a further refinement, based on the signal from the sensor 106 and a determination by the programmable logic controller 130 that there is normal flow, a control signal may also be transmitted to a pump 126 (FIG. 6) for injecting additional materials, such as asphalt cement (AC) or an asphalt rejuvenator, via the injection port 87 and into the coater 80 (FIG. 4).

Referring again to FIG. 5, in this exemplary embodiment, the flow control unit 90 also includes a high-limit switch 108 in the hopper 92. If the RAP is backed up in the hopper 92, the switch is activated and transmits a signal indicative of this condition to the above-described programmable logic controller 130. The programmable logic controller 130 will then transmit a signal to the hydraulic or pneumatic cylinder 98 of the flow control gate 96 to open a predetermined amount. In one preferred implementation, the flow control gate 96 will open in predetermined increments and at predetermined intervals until the switch 108 is deactivated.

Finally, and referring still to FIG. 5, in this exemplary embodiment, the flow control unit 90 also includes a bypass conduit 110 and associated divert gate 112. The divert gate 112 is moved by a hydraulic or pneumatic cylinder 114 between: a first position in which it prevents flow into the bypass conduit 110; and a second position in which it blocks access to the conduit 94 and directs RAP into the bypass conduit 110. The divert gate 112 may be moved to the second position, for example, to allow for cleanout at the end of a production run. The operation of the hydraulic or pneumatic cylinder 114 of the divert gate 112 is also preferably controlled by the above-described programmable logic controller 130. Specifically, in this exemplary embodiment, the cylinder 114 includes a rod 116 that is extended or retracted. The rod 116 is connected to a linkage 118, which, in turn, is connected to a shaft 120. The divert gate 112 is mounted to the shaft 120. Thus, extension or retraction of the rod 116 results in rotation of the shaft 120, and thus, rotation of divert gate 112 between the first position and the second position.

Although not shown in FIG. 6, it should be recognized and understood that the above-described programmable logic controller 130 could also be used to control other components of the system, including, for example, a feed conveyor that supplies the RAP, the auger 50, the coater 80, and/or a discharge conveyor that carries away the processed RAP. In other words, the programmable logic controller 130 could be programmed to control all functions of the system of the present invention.

Figure 7:
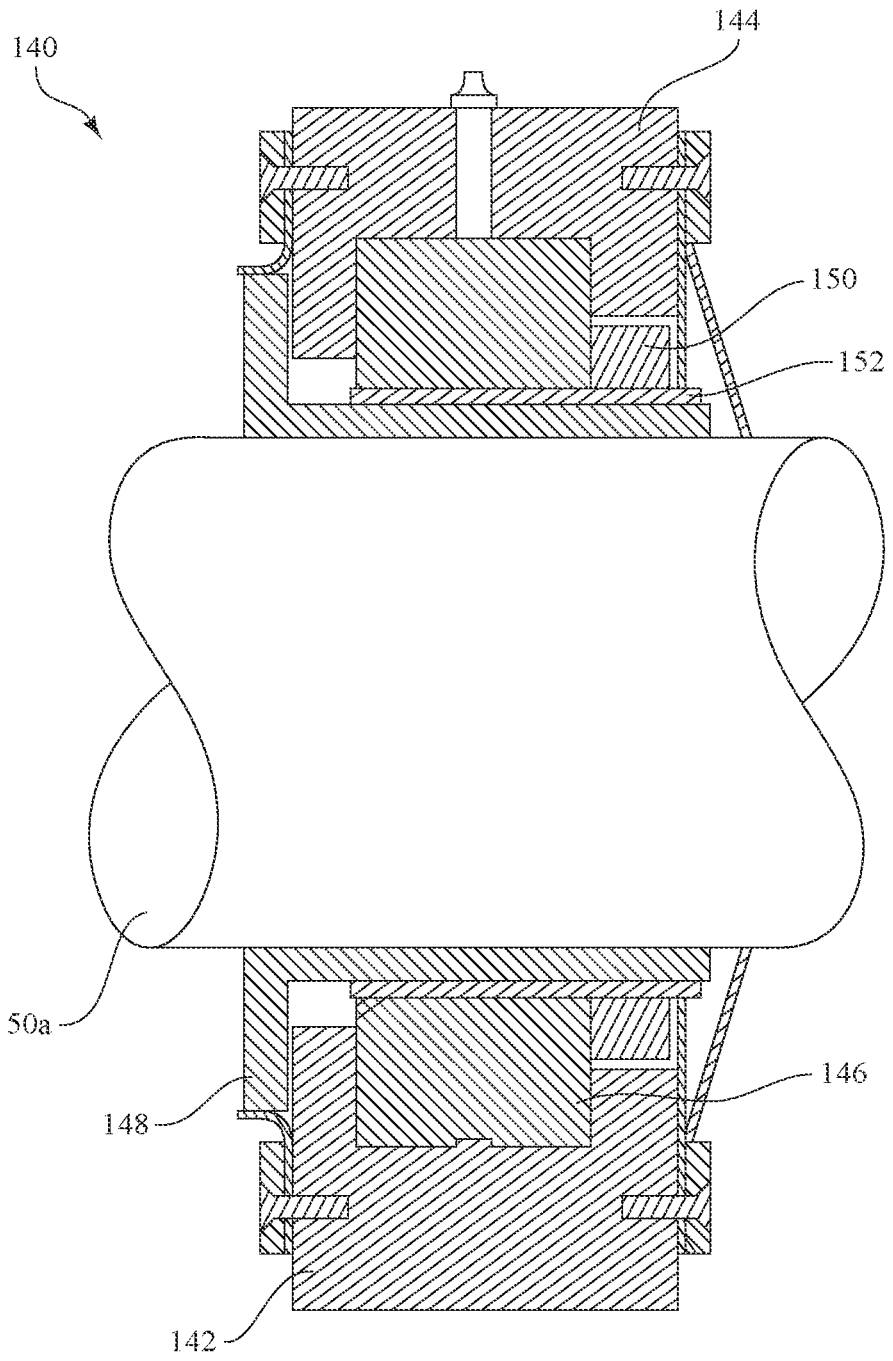
FIG. 7 illustrates a preferred bearing arrangement for supporting the auger of the heating and drying unit of the exemplary system of FIG. 1.

As a further refinement, FIG. 7 illustrates a preferred bearing arrangement 140 for supporting the distal ends of the shaft 50*a* of the auger 50. The bearing arrangement includes a two-piece (or split) housing, with a lower bearing housing 142 and an upper bearing housing 144. The bearing arrangement further includes a bearing 146 that is comprised of a double-row of barrel-shaped rollers, such as the Dodge® bearing distributed and sold as Model No. 23048K. (Dodge® is a registered trademark of ABB Asea Brown Boveri Ltd. of Zurich, Switzerland.) Furthermore, in this preferred bearing arrangement, and as shown in FIG. 7, the shaft 50*a* is mounted and positioned with respect to the bearing 146 by a shaft adapter 148. Furthermore, the preferred bearing arrangement 140 includes locking ring 150, along with a tapered locking sleeve 152. As a result of this arrangement, there is a reduced current draw on the motor that drives the auger 50. Furthermore, this arrangement prevents side-to-side movement of the auger 50, thus eliminating or at least minimizing the possibility of contact between the breaker bars 25 and the trough 60.

An exemplary method for processing recycled asphalt pavement for use in asphalt production thus comprises the steps of: (i) introducing recycled asphalt pavement into a heating and drying unit 30, including a trough 60 positioned within an external housing 32, wherein the trough 60 is constructed of two or more sections 60*a*, 60*b* to allow for thermal expansion, with only one end of each of the two or more sections 60*a*, 60*b* connected to the external housing 32, and wherein a hollow auger SO is positioned in the trough 60; (ii) rotating the hollow auger 50 within the trough 60 to transport the recycled asphalt pavement received at a first end of the trough 60 to a second end of the trough 60; (iii) introducing heated air into the heating and drying unit 30, entering the trough 60 via an inlet 62 and exiting the trough 60 via an outlet 64; (iv) introducing heated oil through the hollow auger SO, entering via an inlet 52 and exiting via an outlet 54; and (v) discharging the recycled asphalt pavement at an elevated temperature from the second end of the trough 60. In some implementations, an exemplary method for processing recycled asphalt pavement for use in asphalt production further comprises the steps of: (vi) introducing the recycled asphalt pavement from the heating and drying unit 30 into a coater 80; and (vii) agitating and mixing the recycled asphalt pavement in the coater 80, liberating moisture from the recycled asphalt pavement.

Additionally, as mentioned above, in certain circumstances, it would be desirable and advantageous to preheat the aggregate before it is introduced into the cold-mix asphalt plant. Referring again to FIG. 1, the same system would be used for such processing of aggregate. The aggregate is introduced into the trough 60 of the heating and drying unit 30, where it is transported from the first end of the trough 60 to the second end of the trough 60 via rotation of the auger 50. The heat exchanger 20 is used to generate heated air and heated oil (or a similar heat transfer liquid). In the heating and drying unit 30, as the aggregate moves from the first end of the trough 60 to the second end of the trough 60, the aggregate is subjected to heat transfer from heated air delivered from the heat exchanger 20 and introduced into the heating and drying unit 30, entering the trough 60 via the inlet 62 and exiting the trough 60 via the outlet 64. Furthermore, in the heating and drying unit 30, heated oil is delivered from the heat exchanger 20 and is pumped through the hollow auger 50, entering via the inlet 52 and exiting via the outlet 54, preferably flowing in a direction opposite to the flow of the aggregate.

An exemplary method for processing aggregate for use in asphalt production in a cold-mix asphalt plant thus comprises the steps of: (i) introducing aggregate into a heating and drying unit 30, including a trough 60 positioned within an external housing 32, wherein the trough 60 is constructed of two or more sections 60*a*, 60*b* to allow for thermal expansion, with only one end of each of the two or more sections 60*a*, 60*b* connected to the external housing 32, and wherein a hollow auger 50 is positioned in the trough 60; (ii) rotating the hollow auger 50 within the trough 60 to transport the aggregate received at a first end of the trough 60 to a second end of the trough 60; (iii) introducing heated air into the heating and drying unit 30, entering the trough 60 via an inlet 62 and exiting the trough via an outlet 64; (iv) introducing heated oil through the hollow auger 50, entering via an inlet 52 and exiting via an outlet 54; and discharging the aggregate at an elevated temperature from the second end of the trough 60.

In using the system to preheat aggregate, however, there would be certain changes in the operating parameters. For example, the speed of the auger 50 could be increased, such that the aggregate can be advanced through the trough 60 at a higher rate as compared to rate at which the aggregate is advanced through the trough 60 for delivery to the hot-mix asphalt plant.

One of ordinary skill in the art will recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A system for processing recycled asphalt pavement for use in asphalt production, comprising:

a heat exchanger for generating heated air and for generating heated oil; and a heating and drying unit, including a trough positioned within an external housing and configured to receive the recycled asphalt pavement, with a hollow auger positioned in and rotating within the trough, such that the recycled asphalt pavement received at a first end of the trough is transported to a second end of the trough via rotation of the hollow auger;

wherein the trough is constructed of two or more sections that are aligned to collectively define a cavity for receiving the hollow auger and to allow for thermal expansion of the trough in a longitudinal direction, with only one end of each of the two or more sections connected to the external housing;

wherein the heated air is delivered from the heat exchanger and introduced into the heating and drying unit, entering the trough via an inlet and exiting the trough via an outlet, increasing a temperature of the recycled asphalt pavement as it moves through the trough; and wherein the heated oil is delivered from the heat exchanger and is pumped through the hollow auger, entering via an inlet and exiting via an outlet, increasing the temperature of the recycled asphalt pavement as it moves through the trough.

2. The system for processing recycled asphalt pavement as recited in claim 1, wherein the inlet for the heated oil introduced into the hollow auger is at the second end of the trough and the outlet for the heated oil from the heating and drying unit is at the first end of the trough.

3. The system for processing recycled asphalt pavement as recited in claim 1, and further comprising multiple guide members positioned at left and right lateral top edges of the trough, each of the multiple guide members being secured to the external housing and extending down over either the left lateral top edge or the right lateral top edge of the trough, thus preventing lateral movement of the trough, but allow for expansion in a longitudinal direction.

4. The system for processing recycled asphalt pavement as recited in claim 1, and further comprising lateral support bars positioned at spaced intervals along the length of the trough, each extending from a left lateral top edge to a right lateral top edge.

5. A system for processing recycled asphalt pavement for use in asphalt production, comprising:

a heat exchanger for generating heated air and for generating heated oil;

a heating and drying unit, including a trough positioned within an external housing and configured to receive the recycled asphalt pavement, with a hollow auger positioned in and rotating within the trough, such that the recycled asphalt pavement received at a first end of the trough is transported to a second end of the trough via rotation of the hollow auger; and a coater configured to receive the recycled asphalt pavement from the heating and drying unit, including a means for agitating and mixing the recycled asphalt pavement, liberating moisture from the recycled asphalt pavement;

wherein the trough is constructed of two or more sections that are aligned to collectively define a cavity for receiving the hollow auger and to allow for thermal expansion of the trough in a longitudinal direction, with only one end of each of the two or more sections connected to the external housing;

wherein the heated air is delivered from the heat exchanger and introduced into the heating and drying unit, entering the trough via an inlet and exiting the trough via an outlet, increasing a temperature of the recycled asphalt pavement as it moves through the trough; and wherein the heated oil is delivered from the heat exchanger and is pumped through the hollow auger, entering via an inlet and exiting via an outlet, increasing the temperature of the recycled asphalt pavement as it moves through the trough.

6. The system for processing recycled asphalt pavement as recited in claim 5, wherein the inlet for the heated oil introduced into the hollow auger is at the second end of the trough and the outlet for the heated oil from the heating and drying unit is at the first end of the trough.

7. The system for processing recycled asphalt pavement as recited in claim 5, and further comprising multiple guide members positioned at left and right lateral top edges of the trough, each of the multiple guide members being secured to the external housing and extending down over either the left lateral top edge or the right lateral top edge of the trough, thus preventing lateral movement of the trough, but allow for expansion in a longitudinal direction.

8. The system for processing recycled asphalt pavement as recited in claim 5, and further comprising lateral support bars positioned at spaced intervals along the length of the trough, each extending from a left lateral top edge to a right lateral top edge.

9. The system for processing recycled asphalt pavement as recited in claim 5, wherein the coater includes an outlet duct, with a vacuum applied to the outlet duct, actively drawing out the moisture that has been liberated from the recycled asphalt pavement.

10. The system for processing recycled asphalt pavement as recited in claim 5, and further comprising a flow control unit that is interposed between the heating and drying unit and the coater and is configured to control flow of the recycled asphalt pavement from the heating and drying unit into the coater.

11. The system for processing recycled asphalt pavement as recited in claim 10, wherein the flow control unit includes:

a conduit; and a flow control gate, which is controlled to modulate flow of the recycled asphalt pavement through the conduit.

12. The system for processing recycled asphalt pavement as recited in claim 11, wherein the flow control unit includes:

a shaft to which the flow control gate is mounted;

a cylinder including a rod that is selectively extended or retracted; and a linkage connecting the rod of the cylinder to the shaft, such that extension or retraction of the rod results in rotation of the shaft, and thus, rotation of the flow control gate to modulate the flow of the recycled asphalt pavement through the conduit.

13. The system for processing recycled asphalt pavement as recited in claim 12, wherein the flow control unit further includes:

a bypass conduit; and a divert gate configured to move between a first position in which it prevents flow into the bypass conduit and a second position in which it blocks access to the conduit and directs the recycled asphalt pavement into the bypass conduit.

14. The system for processing recycled asphalt pavement as recited in claim 13, wherein the flow control unit further includes:

a second shaft to which the divert gate is mounted;

a second cylinder including a rod that is selectively extended or retracted; and a second linkage connecting the rod of the second cylinder to the second shaft, such that extension or retraction of the rod results in rotation of the second shaft, and thus, rotation of the divert gate between the first position and the second position.

* * * * *